United States Patent [19]

Pavlick

[11] Patent Number: 4,771,702

[45] **Date of Patent: * Sep. 20, 1988**

[54] COVERED HOPPER CAR

[75] Inventor: Michael J. Pavlick, Norristown, Pa.

[73] Assignee: The Budd Company, Troy, Mich.

[ * ] Notice: The portion of the term of this patent subsequent to Oct. 20, 2002 has been disclaimed.

[21] Appl. No.: 822,369

[22] Filed: Jan. 27, 1986

Related U.S. Application Data

[63] Continuation of Ser. No. 670,446, Dec. 24, 1984, abandoned, which is a continuation of Ser. No. 473,371, Mar. 8, 1983, abandoned, which is a continuation of Ser. No. 236,861, Feb. 23, 1981, abandoned.

[51] Int. Cl.[4] ..... B61D 3/14; B61D 7/02

[52] U.S. Cl. ..... 105/4.1; 105/248

[58] Field of Search ..... 105/3, 4 R, 239, 240, 105/247, 248, 250, 253, 254, 280, 282 R, 282 A, 282 P, 4.1, 4.2, 4.3, 282.1, 282.2, 282.3

[56] References Cited

U.S. PATENT DOCUMENTS

| | | | |
|---|---|---|---|
| 3,002,470 | 10/1961 | Flowers | 105/250 |
| 3,253,556 | 5/1966 | Glaser et al. | 105/247 |
| 3,572,252 | 3/1971 | Coover et al. | 105/248 |
| 3,631,812 | 1/1972 | Winslow, Jr. | 105/282 R |
| 3,675,591 | 7/1972 | Nagy et al. | 105/253 |
| 3,896,945 | 7/1975 | Bjorklund et al. | 105/250 |

OTHER PUBLICATIONS

The Railway Age Weekly publication, dated Jul. 28, 1969, pp. 21–23; Jan. 7/14, 1963, pp. 22–25.

*Primary Examiner*—Johnny D. Cherry

*Attorney, Agent, or Firm*—E. M. Farrell; Herman Foster; T. I. Davenport

[57] ABSTRACT

A hopper car comprises two substantially similar units which are relatively short and have low roof lines. A pair of trucks is connected to opposite ends of the car. A third truck is connected between the two units. A coupler between the units and the third truck provides articulation therebetween.

1 Claim, 3 Drawing Sheets

COVERED HOPPER CAR

This is a continuation of application Ser. No. 670,446, filed Dec. 24, 1984, now abandoned, which is a continuation of application Ser. No. 473,371, filed Mar. 8, 1983, now abandoned, which is a continuation of application Ser. No. 236,861, filed Feb. 23, 1981, now abandoned.

BACKGROUND OF THE INVENTION

Covered hopper car types have been used extensively for chemical and petrochemical products. Also such covered hopper cars are used for handling grain. Products that are perishable or require protection from contamination and weather, such as food products, have also contributed to the growth of covered hopper cars. Covered hopper cars also still have some use for the cement service.

The covered hopper car makes it possible to ship materials in bulk that were formerly handled in bags or barrels. Generally, they have replaced the box car with grain doors in the bulk movement of that commodity. Such cars are often made with fully insulated structures and equipped with refrigeration for the bulk movement of perishables. Humidity control equipment is installed on some cars for the protection of chemicals and food products.

Many covered hoppers haul polyethylene plastic pellets or other petrochemical products which constitute the raw materials of finished plastic products. These cars have interior linings which are corrosion resistant and can be cleaned to prevent contamination.

The present invention is directed to the mechanical and structural features of a novel type of hopper car without regard to the particular types of material to be carried.

In the design of a high performance covered hopper car, it is desirable to reduce the forces at the wheel to rail interface. The static forces will not significantly change unless there is an increase in the number of axles carrying the load. Generally, if more trucks are employed, a better load distribution is achieved and lower static wheel forces will result. The problem then becomes controlling the dynamic loads. There are vertical and lateral dynamic loads that must be considered. The present invention is directed primarily to the vertical dynamic loads.

Excessive dynamic vertical wheel loads can come from several sources. The most notable source is the "rock-and-roll" problem which can be severe enough to cause wheel lift and de-railments. The major source of the rock-and-roll problem is the high center of gravity of a loaded covered hopper coupled with poor track conditions and truck centers. Having the truck centers less than 39 feet will also tend to inhibit rock-and-roll because this is generally the distance between rail joints.

Lowering the roof line on a hopper car will reduce the center of gravity of the car. However, if the car is made the same length with the lowered roof line, its load carrying capacity will decrease. If the roof line is lowered and the car made longer, then the excess length of the car will make it difficult and sometimes impossible to negotiate turns when there are obstructions along sides of the road bed.

OBJECTS OF THE INVENTION

It is an object of this invention to provide an improved hopper car with a lower center of gravity than many conventional hopper cars.

It is a further object of this invention to provide a freight car which is lower than many conventional hopper cars and thereby able to pass under lower structures.

It is still a further object of this invention to provide an improved hopper car with means to provide improved load distribution.

It is still a further object of this invention to provide an improved hopper car which is relatively long and still capable of negotiating turns.

BRIEF SUMMARY OF THE INVENTION

In accordance with the present invention, a covered hopper car includes a pair of relatively short substantially similar units having relatively low roof lines to provide low centers of gravity. A pair of trucks are connected to opposite ends of the hopper car with a third truck being connected between the two units. A connector between the third truck and the units provide articulation therebetween. Three hopper compartments are provided in each of the units with the two outer compartments each having one outer end slope extending over the end of one of the pair of trucks with another inner end slope both extending over the third truck.

Other objects and advantages of the present invention will be apparent and suggest themselves to those skilled in the art, from a reading of the following specification and claims, taken in conjunction with the accompanying drawings.

DETAILED DESCRIPTION OF THE PREFERRED EMBODIMENTS

Figure 1:
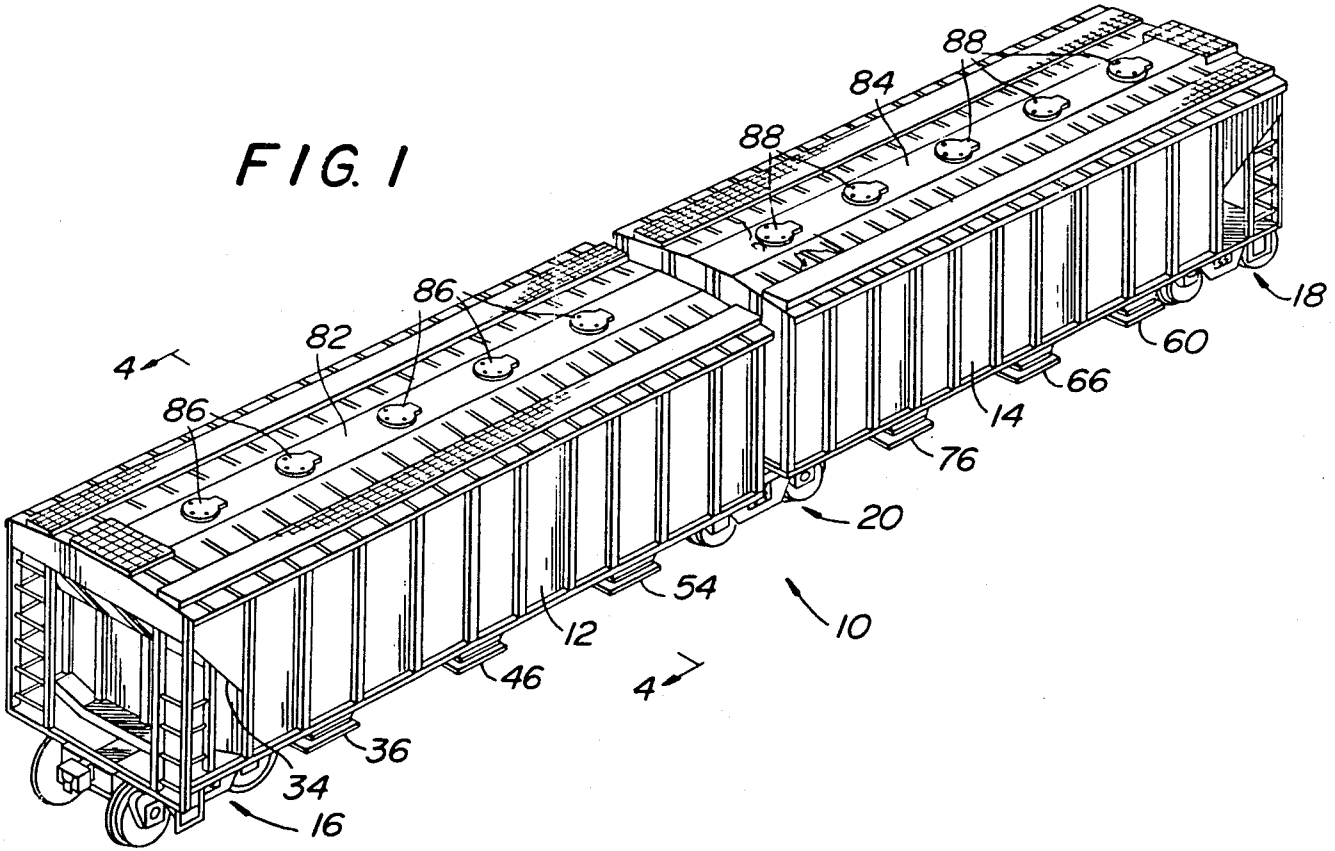
FIG. 1 is an isometric view of a covered hopper car comprising two similar units, in accordance with the present invention.
Figure 2:
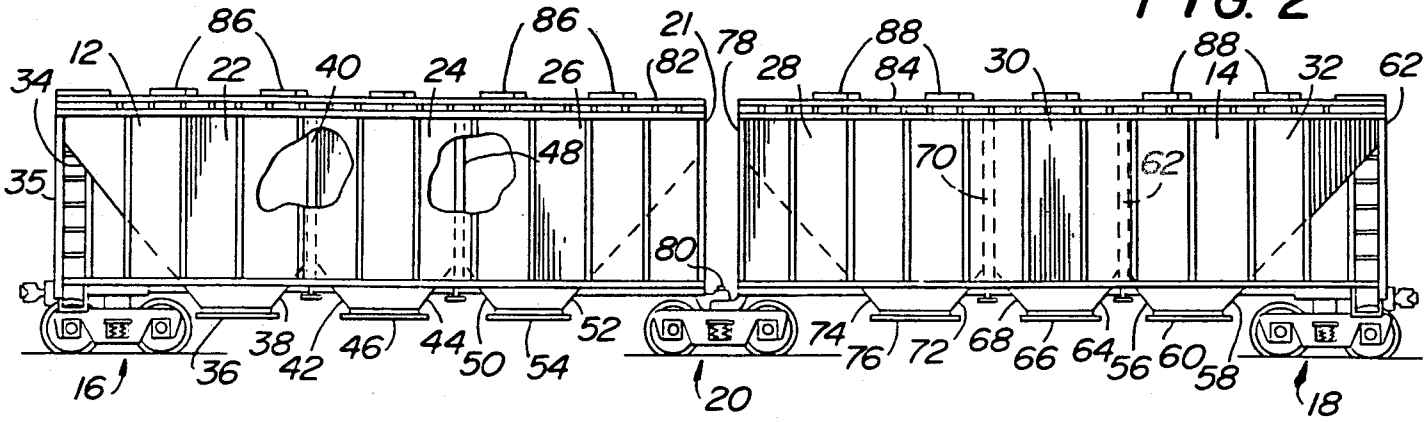
FIG. 2 is a side view of the covered hopper car illustrated in FIG. 1.
Figure 3:
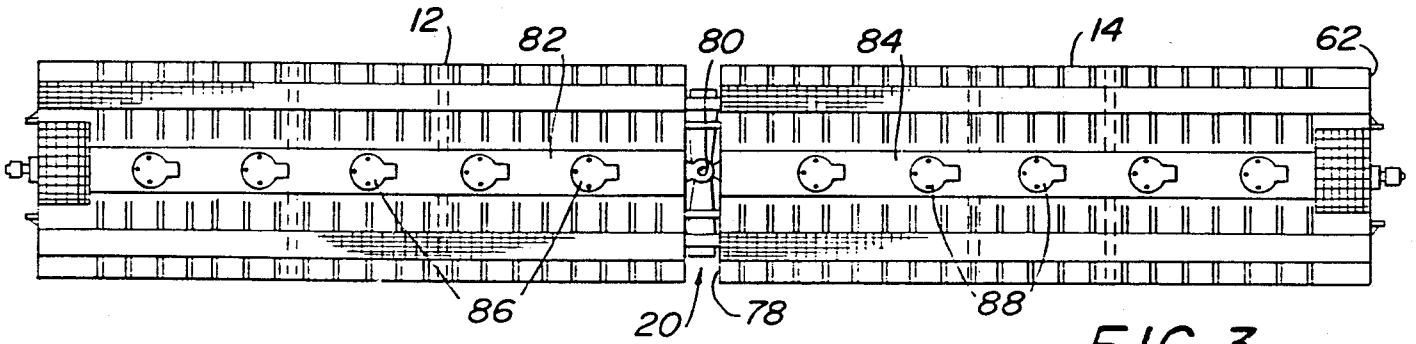
FIG. 3 is a top view of the covered hopper car illustrated in FIG. 1.

A hopper car 10 comprises a pair of substantially identical units 12 and 14. The two units 12 and 14 are supported at the ends by wheel assemblies 16 and 18 which include trucks with wheels and axles. A third wheel assembly 20, also including a truck with wheels and axles, supports the two units 12 and 14 at their inner ends.

The hopper car 10 comprises a two unit articulated car which offers a significantly lower roof line with a much lower load car center of gravity using standard truck features which will contribute to reduce rail loads. The total car has a carrying volume of 5250 cubic feet divided evenly between the two units 12 and 14. The total car length is 75 feet over strikers and has a calculated lightweight of approximately 77,000 lbs. The loaded center of gravity height will vary with the density of the cargo carried but with a 42 lb. per cubic foot material, the center of gravity is approximately 78 inches above the top of the rail. A 100 ton truck unit 20 will be used at the center of the car while 70 ton trucks will be used at the outside positions.

Each of the units 12 and 14 include three compartments. The unit 12 includes compartments 22, 24 and 26 and the unit 14 includes compartments 28, 30, and 32. All of the hopper compartments 22, 24, 26, 28, 30 and 32 include opposed side slope sheets and end slope sheets which funnel downwardly through bottom discharge openings in the hopper compartments. The two end compartments in each of the units 12 and 14 are larger than the center ones.

The outside end compartment 22 includes an inclined slope 34 extending from the end 35 of the unit 12 to a gravity gate outlet structure 36. The slope 34 extends over the end assembly 16. The slope portion 38 also leads to the gate structure 36. The gate outlet structure 36 may be conventional and include a sliding element adapted to open and close the bottom portion of the hopper compartment. The sloped portion 38 leads from the gate 36 to a bulkhead 40 which forms a wall for the compartment 22.

The hopper compartment 24 includes a pair of slope portions 42 and 44 leading from a gravity gate outlet structure 46. The sloped portions 42 and 44 extend from the gate structure 46 to the bulkhead 40 and a bulkhead 48, respectively.

The hopper compartment 26 includes slope sections 50 and 52 connected to gravity gate outlet structure 54. The slope portion 50 is connected between the gate structure 54 and the bulkhead 48 while the sloped portion 52 extends from the gate structure 54 to an end wall 21 partly over the center assembly 20.

The outer hopper compartments 22 and 26 are larger than the center compartment 24. For this reason, the outer compartments have two hopper covers for better loading while the center compartment has only one.

The arrangement of the unit 14 is substantially the same as that of unit 12. The outer compartment 32 includes a pair of slope portions 56 and 58 leading to a gate structure 60. The slope portion 56 is connected between the gate structure 60 and a bulkhead 62 whereas the slope portion 58 is connected between the gate structure 60 and the end of the car 62 extending over the end assembly 18. The center compartment 30 includes a slope portion 64 connected between a gate structure 66 and a bulkhead 62. In like manner the slope portion 68 is connected between the gate structure 66 and a bulkhead 70.

The inner compartment 28 includes slope portions 72 and 74 connected to gate structure 76. The slope portion 74 is connected between the gate 76 and the inner end of the car 78 and extends over the center assembly 20. The slope portion 72 is connected between the gate structure 76 and the bulkhead 70.

The outer compartments 28 and 32 are larger than the center compartment 30. Many of the items illustrated are conventional and will not be described in detail. The features of the invention involve the shorter units with low roof lines in which articulation is provided between the units. The basic car design illustrated would use a standard center sill construction. The car body would normally be made of steel except for the roof which would be lightweight high strength aluminum. All other equipment such as the trucks, couplers, draft gear, air brakes and hand brakes which are used with the car would be standard items common to any railway hopper car. One non-standard item is the articulated connected between the truck articulator connector 80 between the center assembly 20 which includes the basic truck and the inner ends of the car units 12 and 14. The roofs 82 and 84 include hatches which normally have cover openings leading to the hopper compartments 22, 24, 26, 28, 30 and 32. The roof 82 includes hatch covers 86 and the roof 84 includes hatch covers 88.

The total car may consist of two identical articulated units. Each unit may be 37 feet, 10 inches over strikers for a total car length of 75 feet, 8 inches over strikers. The truck centers may be 32 feet, 7 inches for each unit. The top of the roof structure may be 12 feet, 5 inches above the top of the rail. The inside width of the car may be 10 feet and the maximum width over safety appliances may be 10 feet, 8 inches. With these dimensions and the short truck centers, the car is an AAR clearance plate B car rather than a plate C car which is common for high capacity covered hopper cars. While the dimensions given involve a particular embodiment, these dimensions may vary according to particular design requirements.

The car volume may be 5250 cubic feet distributed evenly between both units 12 and 14. The car body structural weight of each unit may be approximately 20,000 lbs. for a 40,000 lbs. per car total. The car's construction may be conventional insofar as the car utilizes a standard steel, double Z-section center sill. The side sills, end sills, corner posts and roof rails may be rolled steel angles. The bolsters may be fabricated from steel plates as may be the sides, bulkheads, and slope sheets. The vertical stiffeners which may be used are rolled steel channels. The car roof may be stamped weldable aluminum alloy with integral stiffening beads. The hatches may also be aluminum and welded to the roof sheets. The hatch covers may be fiberglass. All of these roof features are to reduce roof weight and therefore keep the center of gravity down.

The car illustrated is designed to meet the AAR Section C strength requirements. The details of the trucks including the wheel assemblies 16, 18 and 20 are not shown in detail because they may be of conventional design. However, the center truck or wheel assembly 20 is adapted to receive the coupling elements of the assembly 80. The coupling assembly 80 includes conventional male and female connector elements connected to the same center pin connection so as to permit the adjacent units 12 and 14 to move about the same common point on the truck. A type of articulated connector adapted to be attached to the truck or wheel assembly 20 illustrated may be of a type manufactured by American Steel Foundries, 1005 Prudential Plaza, Chicago, Ill., 60601.

The use of the third truck in the car provides better load distribution and lowers the static wheel forces. The articulation coupler 20 assists in inhibiting rock and rock movement and reduces slack run out between the units. The articulated action between the units reduces the curving forces thereby increasing the life of the wheels of the car.

Figure 4:
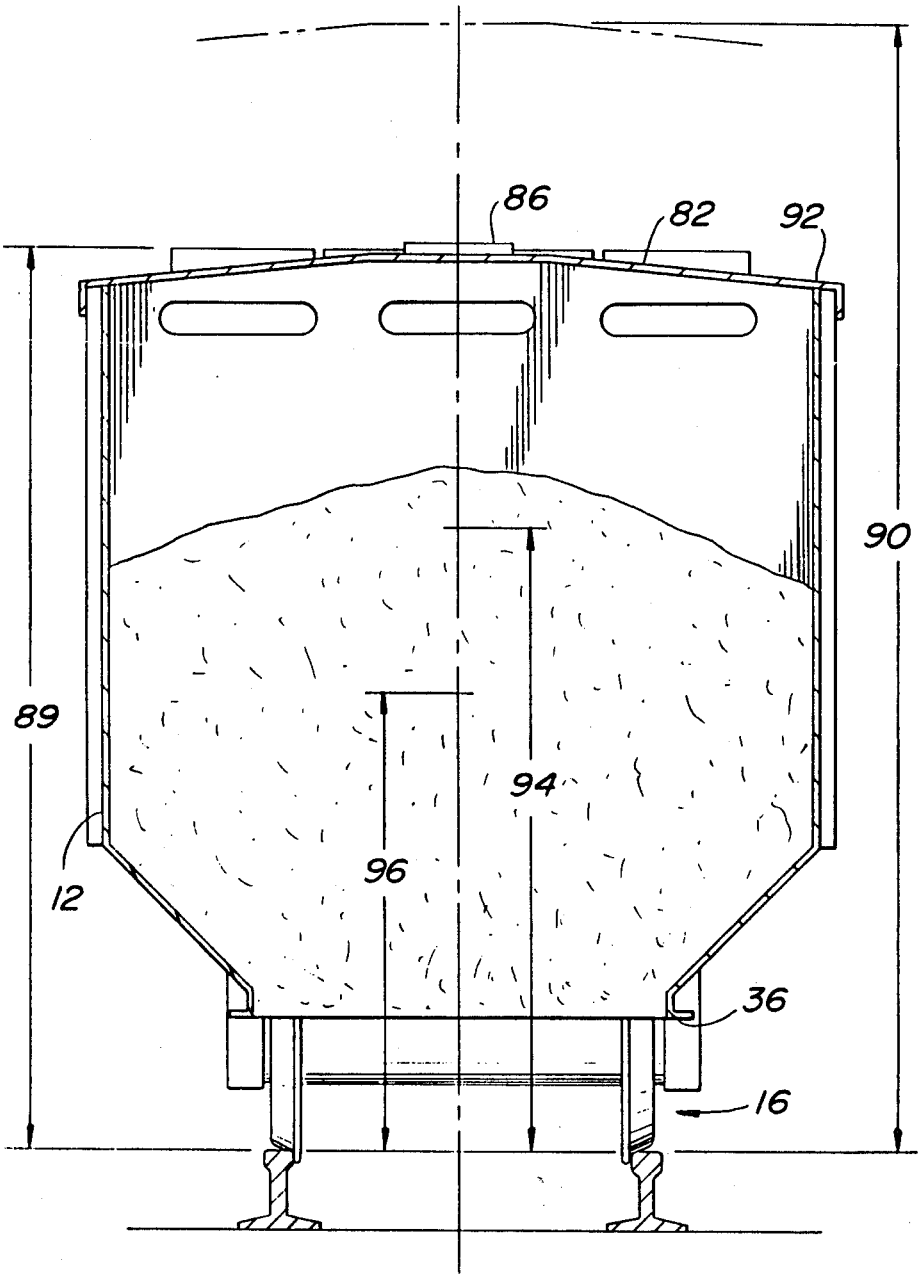
FIG. 4 is a cross-sectional view taken along lines 4—4 shown for the purposes of comparing the height and center of gravity of a hopper car of the present invention with those of a typical conventional hopper car.

Referring to FIG. 4, a line 90 illustrates the AAR plate B clearance line. The line 89 corresponding to the roof illustrates the height of the covered hopper car covered by the present invention. Because of the relatively low height of the units 12 and 14, the center of gravity of the units are considerably lower than the center of gravity of conventional cars. For example, a line 94 illustrates the center of gravity for a conventional hopper car whereas the line 96 illustrates the center of gravity for a hopper car of the type covered by the present invention.

The size of the car 10 may be increased by adding center units which would use the articulated connector at each end. The center unit would be 32 feet, 7 inches over truck centers and would have a capacity of approximately 2500 cubic feet. Any reasonable number of these center units could be added with a given railroad operating procedure being the controlling issue.

A copending application entitled "A Low-Level Freight Car for Carrying Trailers", Ser. No. 434,294 filed Oct. 14, 1982, now U.S. Pat. No. 4,456,413, assigned to the same assignee as the present invention, discloses and discusses some of the features relating to the center truck or wheel assembly 20 and coupler assembly 80.

It is thus seen that a hopper car of the type involving the present invention has a much lower roof line than conventional cars to improve the center of gravity. The roof may be under 13 feet as compared to 15 feet for a conventional hopper car. At the same time, the load carrying capacity is not diminished because the total length of the car, made up of two units, is made longer.

The total length of the car may be 75 feet which is longer than conventional cars, but being separated into two articulated units, is able to negotiate turns. The steering for the increased length of the car is taken care of by the articulated connection in the manner illustrated.

The center of gravity of the hopper car illustrated is lowered considerably since the inner sections of the hopper compartments between the vertical bulkhead and slope sheets are moved down adding more usable volume to the lower half of the car.

What is claimed is:

1. A covered hopper car having a rigid roof and adapted to ride on a pair of spaced rails comprising:

(a) a pair of substantially similar relatively short car units having a total length of about 75 feet and having relatively low roof lines of about 13 feet;

(b) first and second truck assemblies connected to opposite ends of said hopper car;

(c) a third truck assembly between said pair of car units having no more than a pair of wheel axle units with one of each of said axle units being disposed below one of said car units;

(d) coupling means for connecting said third truck assembly to both of said pair of car units at a common connection to provide articulation therebetween;

(e) means providing two outer separate hopper compartments in each of said car units;

(f) said outer compartments of said car units at the ends of said hopper car each including an outer slope portion extending over said first and second truck assemblies, respectively;

(g) said outer compartments of said car units which are disposed towards the center of said hopper car including an outer slope portion extending over said third truck assembly;

(h) said outer compartments of said car units including end walls and each of said outer compartments including at least one hatch opening leading thereto;

(i) gate structures extending laterally approximately the width of said spaced rails and connected towards the bottom of said compartments to provide more usable volume and a low center of gravity for said hopper car; and (j) said slope portions of said outer compartments of said car units which are disposed towards the center of said hopper car extending from said end walls of said car units to the gate structures including therein.

* * * * *